US010001274B2

(12) United States Patent
Pardo et al.

(10) Patent No.: US 10,001,274 B2
(45) Date of Patent: Jun. 19, 2018

(54) METHOD FOR CONDUCTING COMBUSTION IN A FURNACE IN ORDER TO LIMIT THE PRODUCTION OF NITROGEN OXIDES, AND INSTALLATION FOR IMPLEMENTING SAID METHOD

(71) Applicant: DEGREMONT, Paris la Defense (FR)

(72) Inventors: Pierre-Emmanuel Pardo, Orsay (FR); Ludovic Morice, Chaumont en Vexin (FR)

(73) Assignee: DEGREMONT (FR)

( * ) Notice: Subject to any disclaimer, the term of this patent is extended or adjusted under 35 U.S.C. 154(b) by 598 days.

(21) Appl. No.: 14/409,797

(22) PCT Filed: Jun. 24, 2013

(86) PCT No.: PCT/IB2013/055168
§ 371 (c)(1),
(2) Date: Dec. 19, 2014

(87) PCT Pub. No.: WO2014/001992
PCT Pub. Date: Jan. 3, 2014

(65) Prior Publication Data

US 2015/0338095 A1 Nov. 26, 2015

(30) Foreign Application Priority Data

Jun. 26, 2012 (FR) ..... 12 56041

(51) Int. Cl.
*F23G 5/30* (2006.01)
*F23G 5/44* (2006.01)
(Continued)

(52) U.S. Cl.
CPC ..... *F23G 5/30* (2013.01); *F23G 5/12* (2013.01); *F23G 5/446* (2013.01); *F23G 5/50* (2013.01);
(Continued)

(58) Field of Classification Search
None
See application file for complete search history.

(56) References Cited

U.S. PATENT DOCUMENTS

2011/0203177 A1* 8/2011 Stroyakovsky ..... B01J 20/20 48/77
2011/0271886 A1* 11/2011 Fujiwara ..... C10L 9/10 110/344

FOREIGN PATENT DOCUMENTS

DE 19714073 10/1998
WO 2011016556 2/2011

OTHER PUBLICATIONS

Corresponding International Search Report for PCT/IB2013/055168 dated Aug. 10, 2013.

* cited by examiner

*Primary Examiner* — David J Laux
(74) *Attorney, Agent, or Firm* — The Belles Group, P.C.

(57) ABSTRACT

A method for conducting combustion in a fluidized bed furnace, in particular having a sand bed, according to which a flow of primary combustion air is blown through the bed, the fuel consisting in particular of organic waste, or of municipal waste, or of sludge from purifying stations, it being possible to inject secondary air (5*a*) into the space (5) in the furnace located above the bed; in order to limit the production of nitrogen oxides NOx and nitrous oxide N2O: the nitrous oxide N2O and nitrogen oxide NOx content of the fumes at the outlet of the furnace are measured (12, 20); the temperature of the fluidized bed is controlled to keep it at the highest admissible value at which the production of nitrous oxide N2O is substantially reduced, while the production of nitrogen oxides NOx is not substantially increased; and the excess air in the fluidized bed is controlled to keep it at the lowest admissible value at which the
(Continued)

production of nitrogen oxides NOx is reduced without adversely affecting the combustion and the temperature of the bed.

15 Claims, 4 Drawing Sheets

(51) Int. Cl.

| | |
|---|---|
| ***F23G 5/12*** | (2006.01) |
| ***F23G 5/50*** | (2006.01) |
| ***F23N 5/00*** | (2006.01) |
| ***F23N 3/00*** | (2006.01) |
| ***F23N 5/02*** | (2006.01) |

(52) U.S. Cl.
CPC ..... *F23N 3/002* (2013.01); *F23N 5/003* (2013.01); *F23N 5/022* (2013.01); *F23G 2203/502* (2013.01); *F23J 2215/10* (2013.01); *F23J 2215/101* (2013.01); *F23N 2037/32* (2013.01)

METHOD FOR CONDUCTING COMBUSTION IN A FURNACE IN ORDER TO LIMIT THE PRODUCTION OF NITROGEN OXIDES, AND INSTALLATION FOR IMPLEMENTING SAID METHOD

PRIORITY

Priority is claimed as a national stage application, under 35 U.S.C. § 371, to international application No. PCT/IB2013/055168, filed Jun. 24, 2013, which claims priority to French application FR1256041, filed Jun. 26, 2012. The disclosures of the aforementioned priority applications are incorporated herein by reference in their entirety.

The invention relates to a process for conducting combustion in a furnace with a fluidized bed, in particular a sand bed, according to which a flow of primary combustion air is blown through the bed, the fuel consisting in particular of organic waste, or of municipal waste, or of sludge from purifying plants, it being possible to inject secondary air into the space in the furnace above the bed.

During a combustion, contrary to sulfur oxides, to acids and to heavy metals, the emissions of which are intrinsically linked to the sulfur, Cl (chlorine), Br (bromine), F (fluorine), I (iodine) and heavy metal content of the fuel used, the amount of nitrogen oxides generated depends, to a certain extent, on the fuel used, but also on the conditions under which the combustion takes place. Therefore, there is no one-to-one relationship between the emissions of nitrogen oxides and the fuel. At the very most, when one has a good knowledge of a given process (coal, heavy fuel oil, natural gas, etc., thermal power plant), it is possible to formulate an emission factor which will be used, inter alia, as a base reference for the advances and reductions in the emissions of nitrogen oxides which might be obtained by subsequent research and development.

The combustion of a hydrocarbon-based compound is therefore always accompanied, in addition to carbon dioxide $CO_2$, water $H_2O$ and nitrogen $N_2$, by a production of nitrogen oxides. These oxides are represented by nitrogen monoxide (NO), nitrous oxide ($N_2O$), and by a very small proportion of nitrogen dioxide ($NO_2$).

From an environmental and health viewpoint, it is important to reduce their emissions since each of these nitrogen oxides has a significant impact:

- NO participates in the acid rain phenomenon and in the formation of tropospheric ozone;
- $N_2O$ is a greenhouse gas which is three hundred and ten times more powerful than $CO_2$.

In order to reduce NOx emissions, processes have been developed, in particular the following two processes:

- a noncatalytic process operating at a high temperature of about 800° C. in the combustion chamber, this process being denoted by the acronym SNCR (selective noncatalytic reduction);
- a catalytic process that operates with regard to the treatment of the flue gases at medium temperature (300° C.-400° C.) or at low temperature (180° C.-230° C.), this process being denoted by the acronym SCR (selective catalytic reduction).

The SCR process makes it possible to abate large amounts of NOx, but at the expense of major economic and environmental drawbacks. The more economical SNCR process does not make it possible to achieve a nitrogen oxide removal efficiency as high as the SCR process.

The objective of the invention is, especially, to reduce as much as possible the production of nitrogen oxides $NO_x$ and of nitrous oxide $N_2O$ during a combustion in order to limit oneself to the use of selective noncatalytic reduction (SNCR) so as to have to treat only the residual in the combustion gases.

The invention consists, by adapting the pair: (fluidized bed temperature and excess air in the fluidized bed), in equilibrating the nitrification and denitrification reactions taking place in the fluidized bed.

According to the invention, the process previously defined is characterized in that, in order to limit the production of nitrogen oxides NOx and $N_2O$:

- the nitrous oxide $N_2O$ and nitrogen oxide NOx content of the flue gases is measured at the furnace outlet;
- the temperature of the fluidized bed is controlled so as to keep it at the highest admissible level at which the production of nitrous oxide $N_2O$ is substantially reduced, while the production of nitrogen oxides NOx is not substantially increased;
- and the excess air in the fluidized bed is controlled so as to keep it at the lowest admissible value at which the production of nitrogen oxides NOx is reduced without adversely affecting the combustion and the temperature of the bed.

Advantageously, the process uses a cocombustion with an auxiliary fuel in liquid, solid or gas form.

A reagent or a catalytic support which improves denitrification can be introduced into the fuel.

Preferably, the temperature of the fluidized bed is controlled so as to keep it between 700° C. and 850° C. The oxygen $O_2$ content in the fluidized bed is advantageously kept between 0% and 6% by volume.

The excess air in the bed can be controlled on the basis of a measurement of the oxygen $O_2$ content of the flue gases at the furnace outlet and of the difference in temperature between the flue gases at the furnace outlet and the fluidized bed.

Advantageously, the flow of secondary air is adjusted so as to keep the excess overall air at the lowest value which ensures complete combustion.

Preferably, according to the process of the invention:

- in order to limit the production of $N_2O$, an algorithm is used in a calculating means of a regulating unit, comprising in particular a PID controller;
- a set-point temperature of the bed (Tref) is introduced into the algorithm,
- the nitrous oxide $N_2O$ content of the flue gases is measured, and the set-point temperature is corrected according to this measured $N_2O$ content,
- the temperature of the bed is measured and its value is introduced into the regulating unit,
- the regulating unit determines, on the basis of the difference between corrected set-point temperature of the bed and measured temperature of the bed, the action to be carried out on the temperature of the combustion air, and/or on the siccity of the fuel, and/or on an optional addition of fuel, in particular of fuel oil, in order to ensure the corrected set-point temperature.

Advantageously, the temperature set-point of the bed, corrected with respect to the $N_2O$ emission, is determined by using a test, this correction being based on the evolution of the production of $N_2O$ over the course of an appropriate reference time, in particular 30 minutes, this test consisting in verifying whether the production of $N_2O$ is in the process of increasing and whether it remains below a predetermined threshold; if the test is valid, the correction is directed toward an increase in the temperature of the bed, and if the test is not valid, the correction is directed toward a decrease in the temperature of the bed; and before the increase in the temperature of the bed, a test is carried out on the ongoing set-point which must remain below the maximum temperature (Tmax) in the bed, whereas, before the decrease in the temperature of the bed, a test is carried out on the ongoing set-point which must remain above the minimum temperature (Tmin) in the bed.

In order to control the production of NOx, the excess air can be controlled by action on the flow of primary air passing through the bed, while taking into account a correction function f(NOx) according to the NOx content of the flue gases at the post-combustion outlet, the NOx control action being limited by the difference in temperature (ΔT) between the bed and the post-combustion, in order to ensure staging of the combustion of the devolatilized hydrocarbons.

Advantageously, a regulating loop controls the excess overall air of the combustion by action on the flow of secondary air, on the basis of an oxygen measurement carried out at the furnace outlet, the total flow of fuel making it possible to determine the total flow of combustion air.

The oxygen content of the fluidized bed can be determined by measuring the oxygen content of the flue gases at the furnace outlet, and by measuring the difference in temperature between the post-combustion zone outlet and the bed outlet with the amount of oxygen consumed during the post-combustion being calculated.

The invention also relates to a facility for carrying out the process previously defined, comprising a fluidized bed combustion furnace, in particular having a sand bed, according to which a flow of primary combustion air is blown through the bed, the fuel consisting in particular of organic waste, or of municipal waste, or of sludge from purifying plants, it being possible to inject secondary air into the space in the furnace located above the bed, this facility being characterized in that it comprises:

- means for measuring, at the furnace outlet, the nitrous oxide $N_2O$ and nitrogen oxides NOx content of the flue gases;
- a regulating unit, comprising in particular a PID controller, with a calculating means for implementing an algorithm for limiting the production of $N_2O$;
- an input for a bed set-point temperature in the algorithm, the regulating unit being suitable for correcting the set-point temperature according to the nitrous oxide $N_2O$ content of the flue gases,
- a means for measuring the temperature of the bed, the value measured being introduced into the regulating unit, said regulating unit determining, on the basis of the difference between the corrected set-point temperature of the bed and the measured temperature of the bed, the action to be carried out on the temperature of the combustion air, and/or on the siccity of the fuel, and/or on an optional addition of fuel, in particular of fuel oil, in order to ensure the corrected set-point temperature.

Advantageously, the facility comprises:

- means for controlling the temperature of the fluidized bed so as to keep it at the highest admissible value at which the production of nitrous oxide $N_2O$ is substantially reduced, while the production of nitrogen oxides NOx is not substantially increased;
- and means for controlling the excess air in the fluidized bed so as to keep it at the lowest admissible value at which the production of nitrogen oxides NOx is reduced without adversely affecting the combustion and the temperature of the bed.

The facility may comprise, in order to control the production of NOx, a means for controlling the excess air by action on the flow of primary air passing through the bed, while taking into account a correction function f(NOx) according to the NOx content of the flue gases at the post-combustion outlet, the NOx control action being limited by the difference in temperature (ΔT) between the bed and the post-combustion, in order to ensure staging of the combustion of the devolatilized hydrocarbons.

Preferably, the facility comprises means for controlling the excess overall air, comprising a probe for measuring the oxygen $O_2$ content of the flue gases at the furnace outlet, temperature probes for providing the difference in temperature between the flue gases at the post-combustion outlet and the fluidized bed, and a means for calculating the oxygen consumed by the post-combustion, corresponding to the difference in temperature between the bed outlet and the post-combustion outlet.

The facility advantageously comprises a regulating loop which controls the excess overall air of the combustion by action on the flow of secondary air, on the basis of an oxygen measurement carried out at the furnace outlet, the total flow of fuel making it possible to determine the total flow of combustion air.

Apart from the arrangements set out above, the invention consists of a certain number of other arrangements to which reference will be more explicitly made hereinafter with respect to an implementation example described with reference to the attached drawings, but which is in no way limiting. On these drawings.

Figure 1:
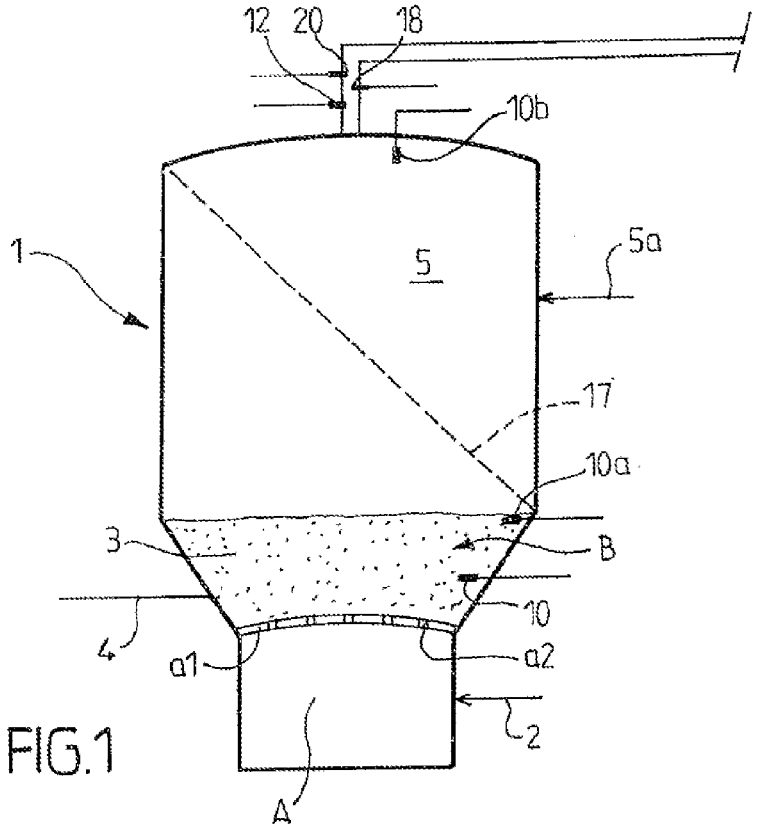
FIG. 1 is a diagrammatic vertical section of a fluidized bed combustion furnace to which the process of the invention is applied.

With reference to FIG. 1 of the drawings, a fluidized bed B combustion furnace 1 can be seen. The fluidized bed B has a homogeneous particle size and preferably consists of sand and of silica grains. Optionally, the fluidized bed can be produced with iron grains, or other grains of metallic or inert material, in particular of coke (fixed carbon) made up of carbon having a crystalline structure and acting as a catalyst.

The combustion air and fluidization air 2 is introduced in the lower part of the furnace in a wind box A surmounted by an arch a1 supporting the bed B. Twyers a2 that ensure the distribution of the primary air blown into the bed B pass through the arch A1. A furnace of this type is known under the name Thermylis® from the company Degremont.

The bed B constitutes a devolatilization zone 3 which contains the waste in the solid phase and in which the volatile matter devolatilize and partly burn. It is recalled that the devolatilization of a fuel denotes the process via which, during a heat treatment, the fuel loses its volatile matter (water, hydrocarbon-based matter, carbon monoxide, hydrogen).

The fuel is introduced at the bottom part of the bed B via at least one side nozzle 4. A post-combustion zone 5 is formed in the chamber of the furnace above the bed B. A device 5*a* for injecting secondary air into the zone 5 is provided.

The injection of the fuel takes place in the devolatilization zone 3. The fuel may consist of purification plant sludge, household or municipal waste, fuel oil, or gas, or a mixture of at least two of these fuels, or any organic waste that is introduced into a furnace in order to burn it.

Advantageously, a reagent or a catalytic support which improves denitrification can be introduced into the fuel.

The fluidized bed B is a vigorously stirred medium in which homogeneous-phase and heterogeneous-phase reactions take place. Most of the phases of a combustion take place in this medium:

- the phase of drying the solid fuel,
- the phase of devolatilization of the volatile matter of the solid fuel,
- the phase of partial oxidation-reduction of the species derived from the devolatilization,
- the oxidation of the fixed carbon.

The bed B is the place conducive to numerous heterogeneous-phase reactions made possible by the appearance of inorganic materials, made up of ash, and of fixed carbon (coke).

It should be noted that the fluidized bed is equivalent to a liquid medium and has, under normal operation, a homogeneous temperature.

Above the bed, the post-combustion zone 5 enables, by virtue of an appropriate excess air and an appropriate residence time, total oxidation of the hydrocarbon-based species produced in the bed in the homogeneous phase (devolatilization).

The nitrogen oxides NOx and the nitrous oxide $N_2O$ are produced in the bed B during the devolatilization phase.

The process of the invention provides an appropriate bed temperature and an appropriate excess air in this fluidized bed in order to promote the denitrification reactions to the detriment of the reactions for producing nitrogen oxides NOx and nitrous oxide $N_2O$, of which the amount produced is reduced.

The process of the invention can be used in synergy with the process of French patent application No. 12 53597 filed on Apr. 19, 2012, under the name of the same applicant company Degremont, for a "Process for denitrification of flue gases produced by a combustion furnace, and facility for carrying out this process".

During the combustion of waste, and of a sludge in particular, the production of nitrogen oxides NOx and of nitrous oxide $N_2O$ comes from the oxidation of the nitrogen contained in the fuel. This nitrogen is contained in a hydrocarbon-based structure, or in the form of ammonia, and can be converted into two species, even in the form of ammonia gas $NH_3$, or in the form of hydrogen cyanide HCN. During the devolatilization of the fuel, in particular of the sludge, the nitrogen of the hydrocarbon-based structures predominantly forms hydrogen cyanide HCN and, in an oxidizing medium, it is responsible for the production of nitrogen oxides NOx and of nitrous oxide $N_2O$.

According to the process of the invention, the conditions prevailing in the fluidized bed are chosen so as to limit the production of hydrogen cyanide HCN and to promote the denitrification reactions which, for the most part, take place in the heterogeneous phase.

For this, the excess air in the fluidized bed is kept at the lowest admissible value in order to avoid the production of nitrous oxides NOx; the lower limit is imposed by the bed/post-combustion difference in temperature $\Delta T$ which characterizes the shift of the combustion from the bed to the post-combustion via the reduction in the excess air in the bed.

The temperature of the fluidized bed is kept at the highest admissible value which is limited by the appearance of a substantial increase in the nitrogen oxides NOx content of the flue gases. This bed temperature kept as high as possible makes it possible:

- to limit the production of nitrous oxide $N_2O$;
- to limit the homogenous-phase oxidation reactions and the reactions which produce nitrogen monoxide NO;
- to provide the level of energy required for the heterogeneous-phase denitrification reactions to take place.

Above a threshold, in particular of 800° C., the temperature of the fluidized bed contributes to limiting the production of hydrogen cyanide HCN and therefore of nitrogen monoxide NO, while at the same time providing the level of energy sufficient for the denitrification reactions to take place, with destruction of the nitrogen oxides NOx and of the nitrous oxide $N_2O$, and destruction of the hydrogen cyanide HCN and of the ammonia $NH_3$ in the heterogeneous phase.

The process of the invention is thus based on the control of the pair: (temperature of the fluidized bed/oxygen concentration in the fluidized bed) so as to give a desired priority to the formation of the denitrification reactions.

Advantageously, the temperature of the fluidized bed is kept between 720° C. and 850° C., while the oxygen concentration in the fluidized bed is kept between 0% and 6% by volume.

Figure 5:
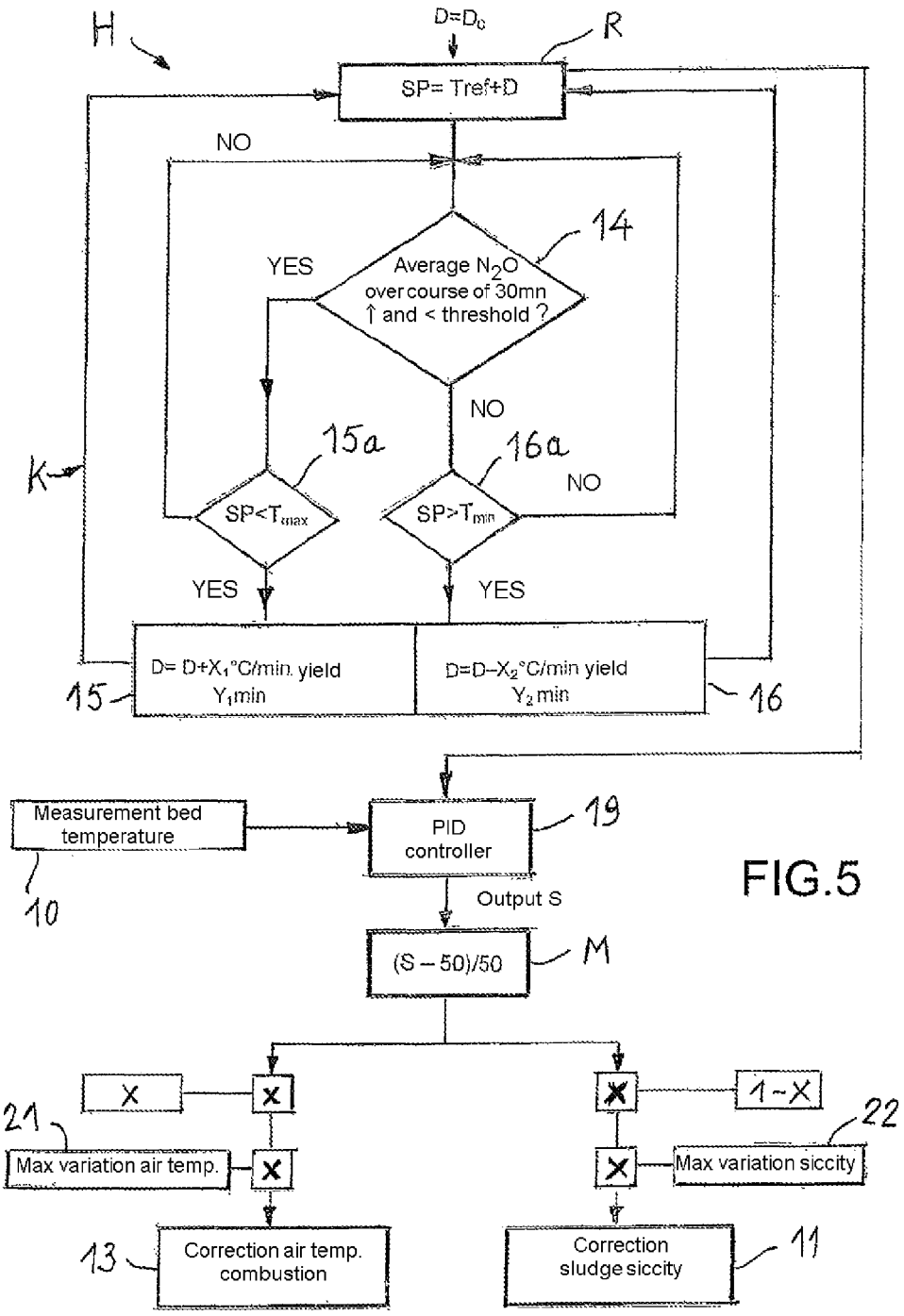
FIG. 5 is a synoptic diagram of an algorithm for ensuring regulating of the $N_2O$ content.
Figure 6:
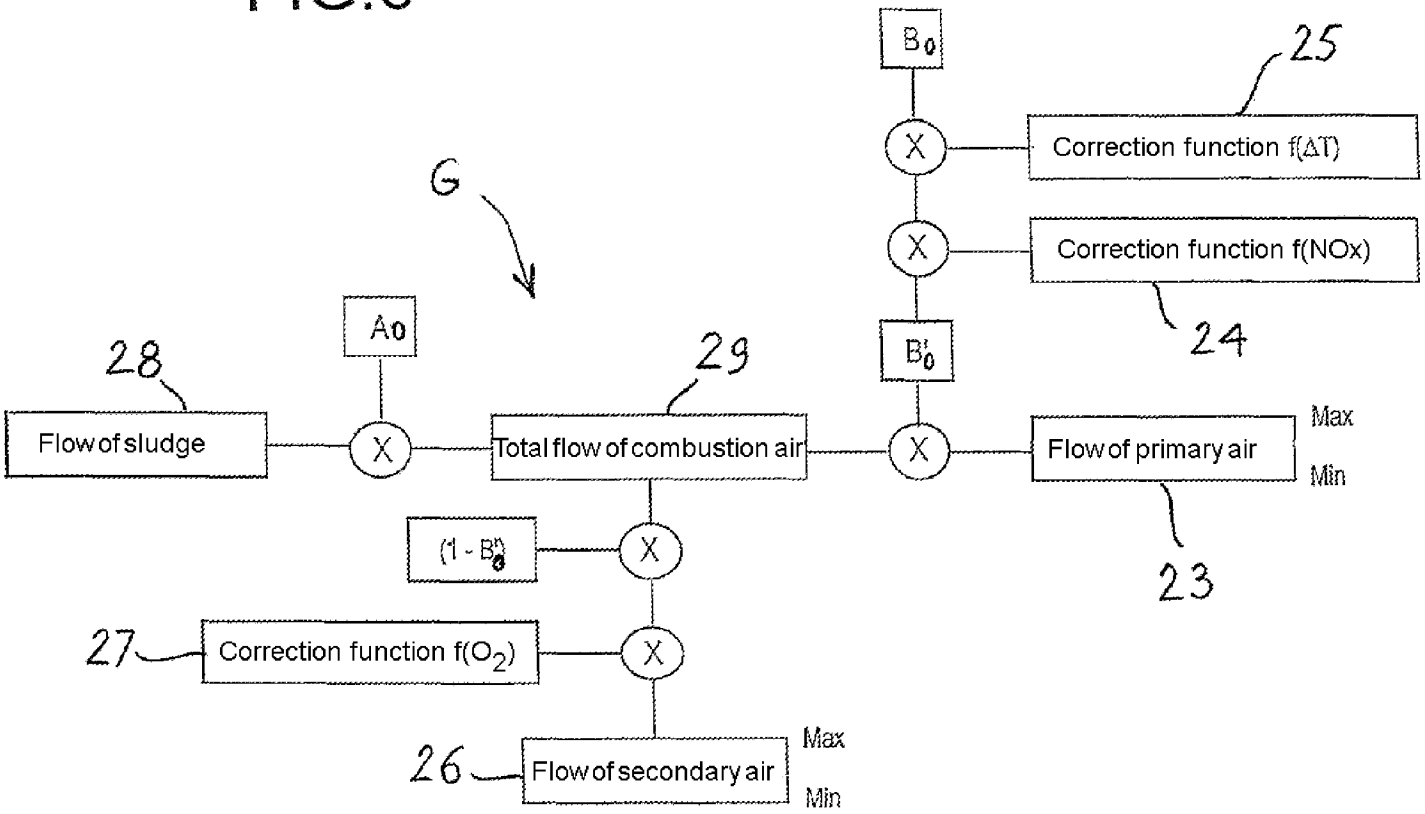
FIG. 6 is a synoptic diagram of the regulation of the excess air in the flue gases at the furnace outlet.

The parameters (temperature of the bed and oxygen content of the bed) are kept in the ranges of values indicated by means of a regulating unit H (FIG. 5) with a calculating means K in which an algorithm is installed, and a regulating loop G (FIG. 6).

The regulating unit H and the loop G receive set-point values and measurement results for the parameters under consideration, and provide, on various outlets, control signals for providing the regulation. This makes it possible to limit the production of nitrous oxide $N_2O$ and of nitrogen oxides NOx, and to promote a denitrification treatment directly in the fluidized bed B without having recourse to a specific denitrification process.

Figure 2:
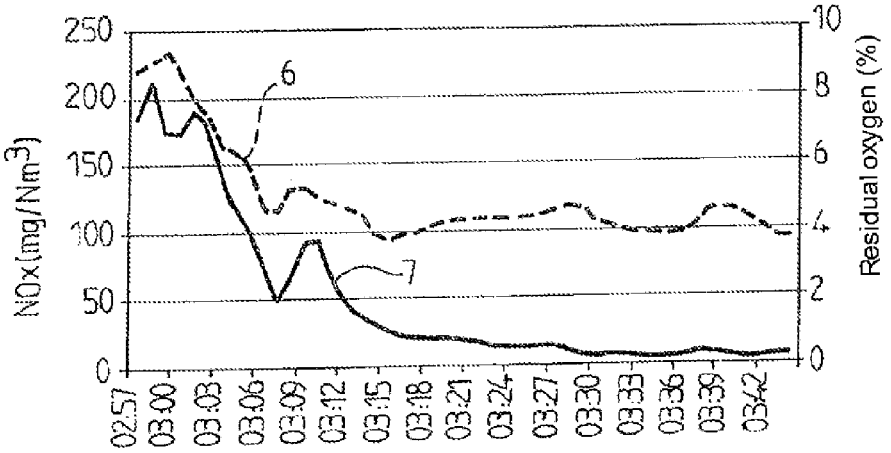
FIG. 2 is a diagram illustrating the variations, over time indicated on the x-axis, of the nitrogen oxides NOx content of the flue gases, indicated on the left-hand y-axis in $mg/Nm^3$, according to a solid-line curve, and also the variations in the residual oxygen content of the flue gases, indicated on the right-hand y-axis and expressed as % by volume, according to a dashed-line curve.

The diagram of FIG. 2 illustrates the possibility of controlling the production of nitrogen oxides NOx, the content of which in the flue gases is indicated on the left along the y-axis, in mg/$Nm^3$ (milligrams per normal cubic meter), by the residual oxygen at the furnace outlet, in the flue gases. The residual oxygen content in the flue gases, expressed as % by volume, is indicated on the right along the y-axis. The time is indicated in hours and minutes on the x-axis.

The dashed curve 6 represents the variation in the oxygen content of the flue gases at the furnace outlet, over time. The curve 6 illustrates a decrease in the residual oxygen at the furnace outlet, obtained by reducing the flow of primary air, while the flow of secondary air is zero.

The solid-line curve 7 illustrates the variation in the nitrogen oxides NOx content of the flue gases at the furnace outlet. It appears that this content decreases with the decrease in the residual oxygen content. As soon as the oxygen content was approximately 4%, the NOx content fell to approximately 30 mg/$Nm^3$.

The diagram of FIG. 2 illustrating the variations in NOx induced by the variations in the residual oxygen content is to be considered with all other things being equal.

Figure 3:
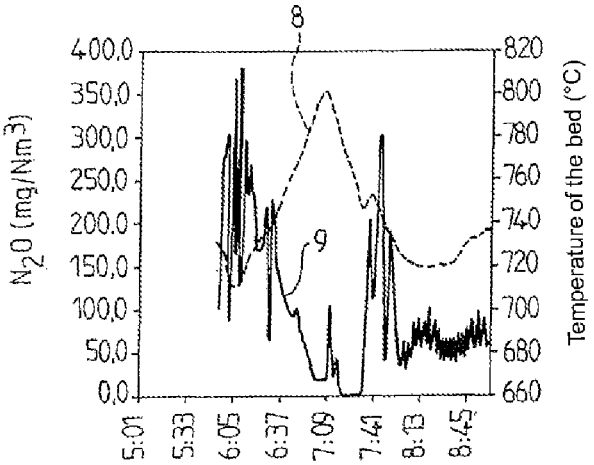
FIG. 3 is a diagram illustrating the variations over time of the average temperature of the sand bed, indicated in ° C. on the right-hand y-axis, according to a dashed-line curve, and also the variations in the nitrous oxide $N_2O$ content in the flue gases, indicated on the left-hand y-axis in $mg/Nm^3$, according to a solid-line curve.

The diagram of FIG. 3 illustrates, via a dashed curve 8, variations in the temperature of the fluidized bed B over time indicated on the x-axis; the temperature values are indicated on the right along the y-axis. The peak of the temperature curve reaches approximately 800° C.

The variations in the nitrous oxide $N_2O$ content in the flue gases at the furnace outlet are represented by the solid-line curve 9. The $N_2O$ content is indicated on the left along the y-axis, expressed in mg/$Nm^3$.

The diagram of FIG. 3 reveals that, for bed temperatures above approximately 740° C., the nitrous oxide $N_2O$ content of the flue gases is substantially reduced.

The invention exploits the evolutions observed on the diagrams of FIGS. 2 and 3 to manage both the production of nitrogen oxides NOx and of nitrous oxide $N_2O$ in the heterogeneous phase constituted by the fluidized bed B.

The invention thus makes it possible, via a precise algorithm, to manage both the production of NOx and the production of $N_2O$ in the heterogeneous phase. In the knowledge that the evolution noted for $N_2O$ and NOx is represented by FIG. 4, the adjustment of the temperature of the bed will be managed via the measurement of $N_2O$ and the $O_2$ set-point will be adjusted according to the NOx content noted for the ongoing temperature.

Figure 4:
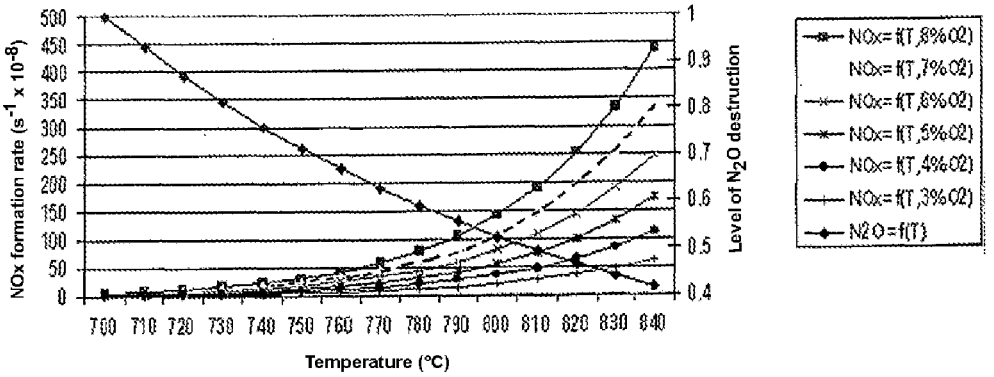
FIG. 4 is a graph illustrating the variations in the NOx and $N_2O$ formation rate as a function of the temperature indicated on the x-axis.

In FIG. 4, the rate of NOx formation as a function of $O_2$ and of the temperature T is indicated on the left-hand y-axis. This rate is expressed in seconds$^{-1}$ ($s^{-1}\times10^{-8}$). The higher this rate relative to the other destruction reactions, the more NOx there will be.

The network of increasing curves from left to right corresponds to the evolution of the rate of NOx formation as a function of the temperature indicated on the x-axis. Each curve corresponds to a constant $O_2$ content, this constant being 3% for the bottom curve and increasing by 1% for each curve located above, until 8% for the top curve; these values are indicated on FIG. 4 on the right. The graph of FIG. 4 shows that, if it is desired to increase the temperature in the bed, it is necessary to jointly reduce the $O_2$ content in order to limit the production of NOx, whence the regulation of the NOx with the amount of air introduced into the bed.

Indicated on the right-hand y-axis is the level of destruction of the $N_2O$ produced by the combustion (ratio of the amount of $N_2O$ produced by the combustion in the bed to the amount of $N_2O$ resulting from the thermal destruction in the bed). This level of destruction is represented by the decreasing curve from the upper left-hand angle to the lower right-hand angle. This curve is independent of the $O_2$ content and shows that the level of destruction depends on the temperature of the bed.

The algorithm can be broken down as set out hereinafter.

I. Control of the Temperature of the Bed B

The algorithm is illustrated in FIG. 5. This control is possible by setting up a regulation of which the principle is the following.

The temperature of the bed B, measured using judiciously implanted probes such as 10 (FIG. 1) is controlled by action:

on the siccity/content of VM of the fuel, this action being represented by the block 11, and on the temperature of the combustion air passing through the fluidized bed, this action being represented by the block 13.

Without participating in the regulation, a probe 10*a* advantageously flows just above the bed and before the injection of secondary air makes it possible to verify the coherence of the measurements 10, 10*b*.

The set-point temperature SP of the bed is corrected with respect to the emission of $N_2O$ using a test, according to block 14. This correction is based on the evolution of the production of $N_2O$ over the course of an appropriate time reference, in particular of 30 minutes, in order to avoid taking the peaks into account.

The test 14 is carried out on this evolution. This test consists in verifying whether the production of $N_2O$ is in the process of increasing and whether it remains below a predetermined threshold.

If the test 14 is valid (answer YES), the correction, provided by the block 15, is directed toward an increase in the temperature of the bed with, beforehand, a test 15*a* on the ongoing set-point SP which must always remain below the maximum temperature Tmax in the bed (of about 850° C.). This increase in temperature is produced in 15 through the activation of a ramp of $X_1$° C./minute for a time reference of $Y_1$ minutes in relation to the thermal inertia of the bed which is dependent on the amount of sand and on the LHV (lower heating value) of the fuel.

If the test 14 is not valid (answer NO), the correction is directed toward a decrease in the temperature of the bed, according to block 16, with, beforehand, a test 16*a* on the ongoing set-point SP which must always remain above the minimum temperature Tmin in the bed (of about 700° C.). This decrease in temperature is produced in 16 through the activation of a ramp of $X_2$° C./minute for a time reference of $Y_2$ minutes in relation to the thermal inertia of the bed which is dependent on the amount of sand and on the LHV of the fuel.

The increase ramp $X_1$° C./minute increments in degrees an up-counter/down-counter D, while the decrease ramp $X_2$° C./minute decrements in degrees the up-counter/down-counter D.

The temperature set-point SP of the bed integrating the correction with respect to the production of $N_2O$ is, according to the block R, the sum of the temperature Tref (basic working temperature of about 800° C.) and of the value provided by the up-counter/down-counter D.

The temperature set-point SP is compared with the measurement in the bed in a PID (proportional integral derivative) controller 19, the output S (0-100%) of which is processed in a formula M ((S−50)/50), the result of which ranges from −1 to +1. A weighting X enables a distribution of the action. The amplitude of the corrections is limited by the "max possible variation" values, respectively according to block 21 for the variation in temperature, and block 22 for the variation in siccity.

A probe 12 (FIG. 1) for measuring the nitrous oxide $N_2O$ content of the flue gases at the furnace outlet provides the measured value of the $N_2O$ content.

The algorithm programmed makes it possible to correct the set-point value according to the measurement of the $N_2O$ content provided by the probe 12.

For a correction of the temperature of the combustion air, the block 13 can control, in particular, a heat exchanger (not represented) which heats the combustion air, using the flue gases exiting the furnace, by modifying the flow of hot flue gases passing through the heater.

The block 11 makes it possible to correct the siccity of the fuel, in particular of the sludge, for example by action on a device for drying the fuel before introduction into the furnace.

According to another possibility, in order to increase the temperature of the bed, it is possible to give a command to add fuel oil to the fuel. A cocombustion then takes place.

When the measured temperature of the bed is too high compared with the set-point value, the correction is made at the level of the correction of the temperature of the combustion air by the block 13 and of the correction of the siccity of the sludge by the block 11, and where appropriate by a reduction of the flow of fuel.

II. Control of the Excess Air at the Heterogeneous Zone Outlet

According to FIG. 6, the excess air is controlled by action on the flow of primary air passing through the bed, according to the block 23. As shown by the graph of FIG. 4, decreasing the amount of primary air, and therefore of $O_2$, results in controlling the production of NOx. A block 24 represents the taking into account of a correction function f(NOx) according to the NOx content of the flue gases, provided by a probe 20 (FIG. 1) at the post-combustion outlet. The amount of primary air is kept at the lowest possible level. This NOx-controlling action is however limited by the difference in temperature ΔT between the bed and the post-combustion, according to the block 25 which introduces a correction function f(ΔT), in order to ensure staging of the combustion of the devolatilized hydrocarbons. The flow of primary air must remain between a maximum value Max and a minimum value Min.

The variation in temperature between the bed B and the outlet of the post-combustion zone 5 is represented in FIG. 1 by a dashed line 17, plotted in a system of coordinates in which the height of a point of the zone 5 above the bed B is indicated on the x-axis, and the temperature at the level of this point is indicated on the y-axis. By way of example, the temperature may be in the region of 800° C. at the outlet of the bed B and of 850° C. at the outlet of the post-combustion zone 5.

The difference in temperature between the outlet of the post-combustion 5 and the bed B should have a sufficient value, in particular of at least 50° C., in order to ensure staging of the combustion of the devolatilized hydrocarbons.

Values $A_0$ and $B_0$ ($B_0<1$) are initial settings which allow only an adjustment through the correction functions.

A loop G determines a corrected value $B'_0$ taking into account the correction functions 25 f(ΔT) and 24 f(NOx). This value $B'_0$ is used to calculate the flow of primary air on the basis of the total flow of combustion air.

The value $(1-B'_0)$ is used to calculate the flow of secondary air on the basis of the total flow of combustion air, taking into account the correction function 27 $f(O_2)$.

As shown by FIG. 6, the reduction of NOx can decrease the proportional coefficient of primary air ($B_0 \rightarrow B'_0$) with, as a consequence, oxygen-depleted gases at the outlet of the bed B. The stoichiometric ratio of overall air ($A_0$) guaranteeing complete combustion in post-combustion 5 for a given amount of VM is provided by an increase in the proportional coefficient of secondary air $(1-B'_0)$. The decreasing of the amount of primary air in order to reduce the production of nitrogen oxides NOx is thus limited by the need for an oxygen content at the outlet of the fluidized bed B.

The coefficients $A_0$ and $B_0$ are a priori settings. $A_0$ defines the amount of air for one metric ton of dry matter DM (for example 10 000 $Nm^3/t$). Therefore, for a sludge set-point of 1 t/h of DM, $A_0$ $Nm^3/h$ (for example 10 000 $Nm^3/h$) of combustion air will be necessary overall, said combustion air having to be distributed between the primary air (air I) and the secondary air (air II).

This is the role of $B_0$ which gives the a priori air I/air II ratio. Therefore, if there is no correction with respect to NOx and ΔT, then $B'_0=B_0$. Conversely, when at least one correction is active, the ratio is modified and $B'_0$ is different than $B_0$.

Thus far, the a priori setting $A_0$ has not been modified. $A_0$ must be modified if the amount of volatile matter or the LHV (lower heating value) thereof changes, and the measurement of the overall oxygen $O_2$ content is an indication thereof. If the result of the measurement justifies it, at this time, an action is carried out on the secondary air by means of the correction function $f(O_2)$ in order to take this into account without providing any modification to the air I, since it is optimized for the control of the NOx.

In FIG. 5 and FIG. 6, the correction functions intervene as multipliers, as illustrated by the sign X. For example, for FIG. 6: the product of the flow of sludge 28 multiplied by $A_0$ gives the total flow of combustion air 29.

III. Control of the Excess Overall Air

The measurement of the excess overall air is carried out using a probe 18 (FIG. 1) for the oxygen content of the flue gases exiting the furnace.

In order to ensure perfect combustion of the amount of VM (volatile matter) introduced, the regulating loop G (FIG. 6) with calculating means controls the excess overall air of the combustion by action on the flow of secondary air, according to block 26, on the basis of the oxygen measurement carried out at the furnace outlet, according to the correction function of the block 27.

The total flow of the sludge which is provided by a block 28 makes it possible to determine the total flow of combustion air, according to the block 29.

The algorithm may be positively improved by the setting up of a measurement of the oxygen content directly in the heterogeneous zone constituted by the fluidized bed B.

However, there is currently no satisfactory means for carrying out such a measurement directly in the bed, in particular a sand bed. This difficulty is overcome by measurement using the probe 18 (FIG. 1) of the oxygen content of the flue gases exiting the furnace, and by calculation of the oxygen consumed by the post-combustion corresponding to the difference between the bed outlet temperature, measured by a probe 10*a*, and the post-combustion outlet temperature, measured by a probe 10*b*.

For the excess overall air, it is desirable, for good combustion, for a small excess oxygen to be present at the outlet in the flue gases. The invention makes it possible to control the amount of air in the fluidized bed and to reduce the nitrogen oxides NOx.

The process of the invention, by limiting the production of nitrogen oxides in a fluidized bed furnace, makes it possible to limit the use of an SNCR reduction.

The invention claimed is:

1. A process for conducting combustion in a fluidized bed furnace, according to which a flow of primary combustion air is blown through the bed, the fuel including one or more of organic waste, municipal waste, and sludge from purifying plants, wherein secondary air is injectable into the space in the furnace located above the bed, and wherein, in order to limit the production of nitrogen oxides NOx and nitrous oxide $N_2O$:

the nitrous oxide $N_2O$ and nitrogen oxides NOx content of the flue gases is measured at the furnace outlet;

the temperature of the fluidized bed is controlled so as to keep it at the highest value, at or below a maximum temperature value, at which the production of nitrous oxide $N_2O$ is substantially reduced;

excess air in the fluidized bed is controlled so as to keep it at the lowest admissible value at which the production of nitrogen oxides NOx is reduced without adversely affecting the combustion and the temperature of the bed; and the excess air of the fluidized bed is controlled on the basis of a measurement of the oxygen O2 content of the flue gases at the furnace outlet and of the difference in temperature between the flue gases at the furnace outlet and the fluidized bed.

2. The process as claimed in claim 1, further comprising using a cocombustion with an auxiliary fuel in liquid, solid or gas form.

3. The process as claimed in claim 1, wherein a reagent or a catalytic support which improves denitrification is introduced into the fuel.

4. The process as claimed in claim 1, wherein the temperature of the fluidized bed is controlled so as to keep it between 700° C. and 850° C.

5. The process as claimed in claim 1, wherein the oxygen O2 content in the fluidized bed is kept between 0% and 6% by volume.

6. The process as claimed in claim 1, wherein action is taken on the flow of secondary air so as to keep the excess overall air at the lowest value which ensures complete combustion.

7. The process as claimed in claim 1, wherein:

in order to limit the production of $N_2O$, an algorithm is used in a calculating means of a regulating unit, comprising a PID controller;

a set-point temperature of the bed is introduced into the algorithm, the nitrous oxide $N_2O$ content of the flue gases is measured, and the set-point temperature is corrected according to this measured $N_2O$ content, the temperature of the bed is measured and its value is introduced into the regulating unit, the regulating unit determines, on the basis of the difference between corrected set-point temperature of the bed and measured temperature of the bed, the action to be carried out on the temperature of the combustion air, and/or on the siccity of the fuel, and/or on an optional addition of fuel in order to ensure the corrected set-point temperature.

8. The process as claimed in claim 7, wherein the temperature set-point of the bed, corrected with respect to the $N_2O$ emission, is determined by using a test, this correction being based on the evolution of the production of $N_2O$ over the course of an appropriate time reference, in particular of 30 minutes, this test consisting in verifying whether the production of $N_2O$ is in the process of increasing and whether it remains below a predetermined threshold; if the test is valid, the correction is directed toward an increase in the temperature of the bed, and if the test is not valid, the correction is directed toward a decrease in the temperature of the bed;

and in that, before the increase in the temperature of the bed, a test is carried out on the ongoing set-point which must remain below the maximum temperature (Tmax) in the bed, while, before the decrease in the temperature of the bed, a test is carried out on the ongoing set-point which must remain above the minimum temperature (Tmin) in the bed.

9. The process as claimed in claim 7, wherein, in order to control the production of NOx, the excess air in the bed is controlled by action on the flow of primary air passing through the bed, while taking into account a correction function f(NOx) according to the NOx content of the flue gases at the post-combustion outlet, the NOx-controlling action being limited by the difference in temperature (ΔT) between the bed and the post-combustion, in order to ensure staging of the combustion of the devolatilized hydrocarbons.

10. The process as claimed in claim 9, wherein a regulating loop controls the excess overall air of the combustion by action on the flow of secondary air, on the basis of an oxygen measurement carried out at the furnace outlet, the total flow of fuel making it possible to determine the total flow of combustion air.

11. The process as claimed in claim 10, wherein the oxygen content of the fluidized bed is determined by measuring the oxygen content of the flue gases at the furnace outlet, and by measuring the difference in temperature between the post-combustion zone outlet and the bed outlet, with the amount of oxygen consumed during the post-combustion being calculated.

12. A facility comprising:

a fluidized bed combustion furnace, according to which a flow of combustion primary air is blown through the bed, the fuel including one or more of organic waste, of municipal waste, and of sludge from purifying plants, wherein secondary air is injectable into the space in the furnace located above the bed;

means for measuring, at the furnace outlet, the nitrous oxide $N_2O$ and nitrogen oxides NOx content of the flue gases;

a regulating unit, comprising a PID controller which is configured with an algorithm for limiting the production of nitrous oxide $N_2O$;

an input for a bed set-point temperature in the algorithm, the regulating unit being configured to correct the set-point temperature in response to the nitrous oxide $N_2O$ content of the flue gases, a means for measuring the temperature of the bed, the measured value being introduced into the regulating unit, in order to control the production of nitrogen oxides NOx, a means for controlling excess air by action on the flow of primary air passing through the bed, while taking into account a correction function f(NOx) according to the nitrogen oxides NOx content of the flue gases at the post-combustion outlet, the NOx-controlling action being limited by the difference in temperature (ΔT) between the bed and the post-combustion, in order to ensure staging of the combustion of the devolatilized hydrocarbons, said regulating unit determining, on the basis of the difference between corrected set-point temperature of the bed and measured temperature of the bed, the action to be carried out on the temperature of the combustion air, and/or on the siccity of the fuel, and/or on an optional addition of fuel, in particular of fuel oil, so as to ensure the corrected set-point temperature.

13. The facility as claimed in claim 12, further comprising:

means for controlling the temperature of the fluidized bed so as to keep it at the highest value, at or below a maximum temperature value, at which the production of nitrous oxide $N_2O$ is substantially reduced;

and means for controlling the excess air in the fluidized bed so as to keep it at the lowest admissible value at which the production of nitrogen oxides NOx is reduced without adversely affecting the combustion and the temperature of the bed.

14. The facility as claimed in claim 12, further comprising means for controlling the excess overall air, comprising a probe for measuring the oxygen $O_2$ content of the flue gases at the furnace outlet, temperature probes for providing the difference in temperature between the flue gases at the post-combustion outlet and the fluidized bed, and a block for calculating the oxygen consumed by the post-combustion, corresponding to the difference in temperature between the outlet of the bed and the outlet of the post-combustion.

15. The facility as claimed in claim 12, further comprising a regulating loop which controls the excess overall air of the combustion by action on the flow of secondary air, on the basis of an oxygen measurement carried out at the furnace outlet, the total flow of sludge fuel making it possible to determine the total flow of combustion air.

* * * * *